US005918970A

United States Patent [19]

Brohard et al.

[11] Patent Number: 5,918,970

[45] Date of Patent: Jul. 6, 1999

[54] OUTDOOR LUMINAIRE ASSEMBLY

[75] Inventors: Bonnie J. Brohard, Hebron; David W. Roberts; John C. McCartney, both of Newark, all of Ohio

[73] Assignee: Holophane Corporation, Newark, Ohio

[21] Appl. No.: 08/590,939

[22] Filed: Jan. 24, 1996

[51] Int. Cl.[6] ..... F21S 1/10

[52] U.S. Cl. ..... 362/370; 362/375; 362/431

[58] Field of Search ..... 362/218, 264, 362/265, 294, 370, 375, 431, 374, 376

[56] References Cited

U.S. PATENT DOCUMENTS

| | | | |
|---|---|---|---|
| 3,071,683 | 4/1961 | Queale | 240/25 |
| 3,094,220 | 6/1963 | Harling | 362/431 |
| 3,156,418 | 11/1964 | Jablonski et al. | 362/431 |
| 3,433,887 | 3/1969 | Driskell | 174/63 |
| 3,903,409 | 9/1975 | Richilano | 362/370 |
| 3,949,211 | 4/1976 | Elms | 240/25 |
| 4,160,286 | 7/1979 | Merritt | 362/431 |
| 4,374,407 | 2/1983 | Drost et al. | 362/432 |
| 4,533,983 | 8/1985 | Hafstad | 362/223 |
| 5,121,309 | 6/1992 | Ewing et al. | 362/226 |
| 5,132,885 | 7/1992 | Hocheim et al. | 362/217 |
| 5,136,493 | 8/1992 | Straus et al. | 362/373 |
| 5,243,508 | 9/1993 | Ewing et al. | 362/431 |

FOREIGN PATENT DOCUMENTS

| | | | |
|---|---|---|---|
| 984359 | 2/1976 | Canada | 362/431 |
| 956254 | 1/1957 | United Kingdom | 362/431 |

*Primary Examiner*—Y. Quach
*Attorney, Agent, or Firm*—Brooks & Kushman

[57] ABSTRACT

An outdoor luminaire assembly adapted to be attached to a mounting stanchion that includes an optical assembly having a lamp for generating light, an arm for supporting the optical assembly from the mounting stanchion, and a ballast which is enclosed within the arm. The optical assembly is adapted to receive and support a cover member which is selected from a group of differently shaped cover members. The cover member is made of a plastic material in order to provide design flexibility. The arm has a removable panel which allows for maintenance-ready access to the ballast and other electrical componentry which is enclosed within the arm.

4 Claims, 6 Drawing Sheets

OUTDOOR LUMINAIRE ASSEMBLY

CROSS-REFERENCE TO RELATED APPLICATION

This application relates to currently pending U.S. design patent application Ser. No. 29/043,838, filed Aug. 30, 1995, entitled "Parking Lot Luminaire", which is assigned to the assignee of the present invention.

1. Technical Field

This invention relates to a luminaire assembly which is particularly suited for outdoor applications such as lighting streets and parking lots.

2. Background Art

Municipalities and private industries alike face the same realizations. They seek to illuminate their streets, walkways and parking lots so that persons may easily and safely function when natural light is low or unavailable. Outdoor luminaires typically provide this desired function as they are normally positioned above the ground and affixed to buildings, poles and other means of support. As those skilled in the art will recognize, luminaire designers must balance several factors in designing outdoor luminaires. Namely, the luminaires must permit easy access for repair and replacement of internal components, withstand varying weather conditions, and also provide a pleasant aesthetic appearance.

Outdoor luminaires typically include a housing and an optical assembly. The housing is generally exposed to the environment and encloses the electrical circuitry including the ballast. The optical assembly contains the lamp and the refractor, which produces and directs light of varying degrees.

Conventional luminaires typically do not provide for convenient access to the ballast or other electrical components. This results in increased installation and maintenance costs because of the limited accessibility afforded by the mechanical design. In general, a ballast is a mechanism used to provide necessary circuit conditions for starting and operating an electric-discharge lamp, such as the high intensity electric-discharge lamps referenced herein.

In the art area of high intensity electric-discharge lamps, such as high pressure sodium lamps, metal halide lamps or mercury lamps, it is widely understood that the ballast typically mandates regular maintenance attention, in the form of repair or replacement. Replacing the ballast in an outdoor luminaire is difficult because it usually involves replacing the entire housing in which the ballast normally sits as well as increases the weight of the housing. Even if the ballast can be serviced independently of the housing, it is often a difficult task, requiring many types of tools and a sturdy work environment.

The luminaire assembly typically cannot be readily disassembled and reassembled while it is sitting atop an elevated pole, due to many factors including its sheer size, the number of tools involved and environmental conditions that may impede a repair process. Therefore the luminaire assembly must be disabled, taken down and off-site for repair and then put back up, which adds to the time, expense and manpower needed to maintain the fixtures. The maintenance procedures often include the disassembly of sometimes heavy and awkward parts as well as the removal, splicing and reconnection of electrical wires.

An outdoor luminaire often serves an aesthetic function as well as a practical one. Just as a public body or private organization plants flowers for beautification of a community, so too may such organizations want to easily and inexpensively change the look of its luminaires from time to time in order to revitalize the entire appearance of the assembly, thereby reviving the look of the property itself.

It is understood by those skilled in the art that the aforementioned maintenance procedures are, of course, further impeded by hostile weather conditions, including heavy winds, rainstorms, lightning, hail, sleet, snow as well as extreme temperature gradients. The maintenance issues inherent in the prior art outdoor luminaire assembly designs have resulted in increased labor and maintenance costs which, in turn, have caused purchasers and manufacturers alike to demand feasible design alternatives.

There are a number of known luminaires for use in an outdoor environment. For example, see U.S. Pat. No. 5,243,508 to Ewing; U.S. Pat. No. 3,949,211 to Elms; U.S. Pat. No. 5,121,309 to Ewing; U.S. Pat. No. 3,071,683 to Queale; and U.S. Pat. No. 4,374,407 to Drost. However shortcomings of these devices are that they are not amenable to having a readily serviceable ballast and electrical componentry or to accommodating a variety of readily-interchangeable, different covers so that the look and feel of the luminaires may be changed periodically. Therefore, they do not provide the advantages set forth above.

Consequently, the improved outdoor luminaire assembly should provide ease of access to the ballast and other internal electrical components in order to allow for more convenient repair and replacement of these parts. These components should preferably be positioned remotely from the housing. Further, the improved outdoor luminaire assembly should provide the option of easily changing the aesthetic appearance of the luminaire.

SUMMARY OF THE INVENTION

It is a principal object of the present invention to provide an outdoor luminaire in which the ballast is readily serviceable in an easily accessible location so that it may be quickly maintained with a minimum amount of cost, labor and tools.

It is a further object of the present invention to provide an outdoor luminaire which has an optical assembly that is adapted to receive one of a variety of different and differently shaped cover members so as to achieve different and appealing aesthetic appearances.

In carrying out the above objects, features and advantages of the present invention, the present invention provides an outdoor luminaire assembly which is attachable to a mounting stanchion and includes an optical assembly having a lamp for generating light. The assembly also includes an arm for supporting the optical assembly from the mounting stanchion and a ballast which is enclosed within the arm for energizing the lamp. The arm preferably includes a removable door which allows for access to the ballast.

In a preferred embodiment, the optical assembly is adapted to receive a cover member. The cover member is selected from a group or plurality of differently shaped cover members. Preferably, the cover member is made of plastic so as to withstand the environmental conditions to which it is exposed as well as provide the ability to cost effectively change its shape or design.

The above objects and other objects, features and advantages of the present invention are readily apparent from the following detailed description of the best mode for carrying out the invention when taken in connection with the accompanying drawings.

BEST MODE FOR CARRYING OUT THE INVENTION

Figure 1:
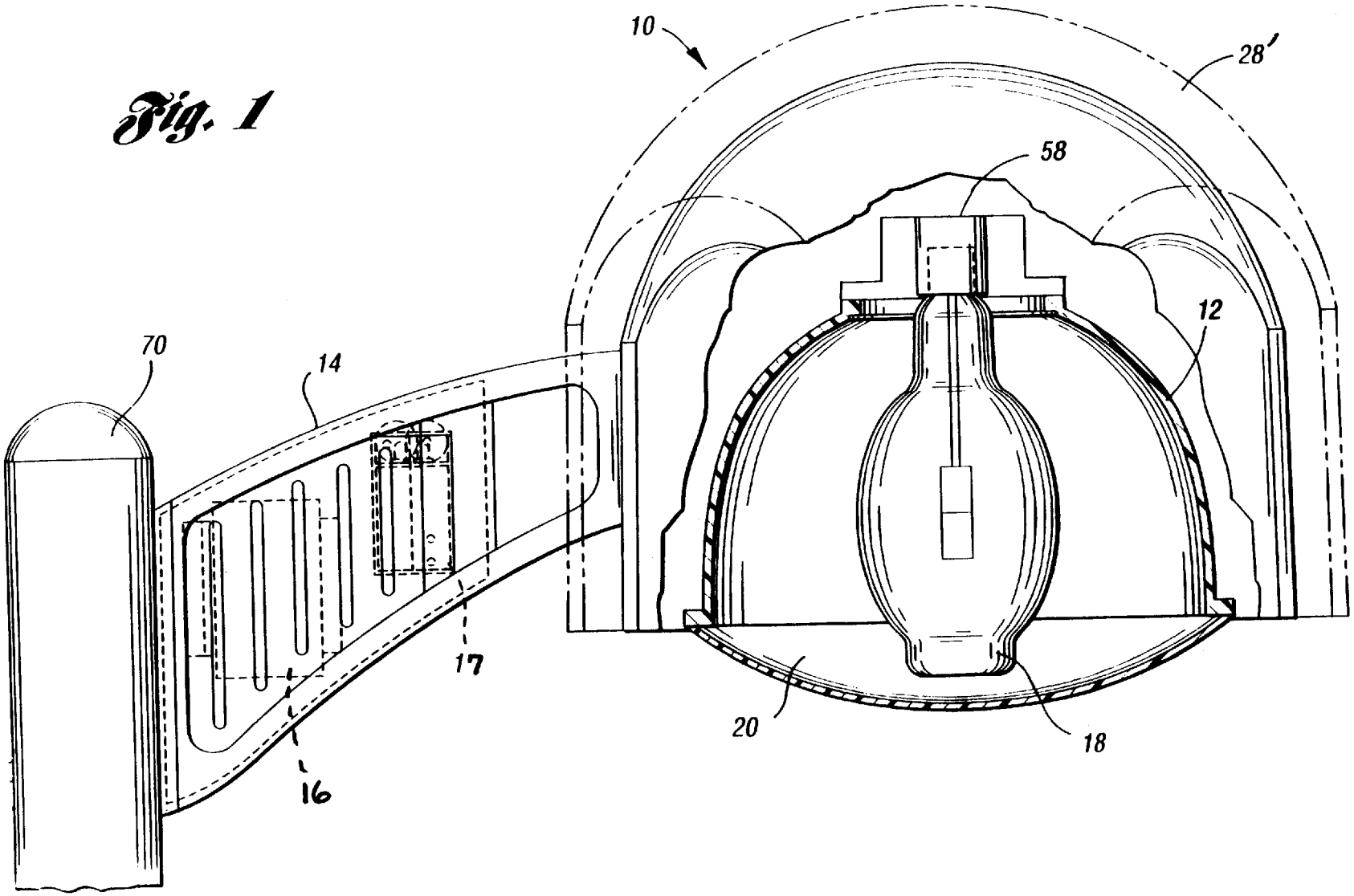
FIG. 1 is a schematic diagram of a first embodiment of the outdoor luminaire assembly of the present invention.

A first preferred embodiment of an outdoor luminaire assembly of the present invention is shown in FIG. 1 of the drawings. As seen, the luminaire assembly 10 includes an optical assembly 12, a ballast 16, and an arm, one style arm being shown in FIGS. 1, 2, 4 and 7 as arm 14 and another style arm being shown in a second preferred embodiment in FIGS. 3 and 8 as arm 14'. As further shown in FIGS. 1–4, the optical assembly 12 is typically a sealed assembly which includes a lamp 18, a glass roundel 20, refractor/reflector 22, glass door 24, socket housing 58, sealing grommet 40, grommet strap 98, and platform 26 for attaching a cover member. One style of cover member is shown in FIGS. 4 and 7 as cover member 28 and another style is shown in FIGS. 1 and 8 as a cover member 28'.

The optical assembly 12 further includes electrical wiring 36 leading from lamp 18 to the ballast 16 and other electrical components, such as a capacitor 17. The ballast 16 is thereby operatively associated with the lamp 18. These various components are electrically connected according to circuit configurations known to those skilled in the art to operate selected luminaires, lighting units and optical assemblies.

In the embodiments illustrated, the cover member is interchangeable by being selectable from a plurality or group of differently shaped cover members. Examples of these cover members are shown in FIGS. 4 and 7 as cover member 28 and in FIG. 8 as cover member 28'. In addition, the cover members shown in U.S. Design patent application Ser. No. 29/043,838, entitled "Parking Lot Luminaire" and filed Aug. 30, 1995 are herein incorporated by reference in the entirety.

Figure 4:
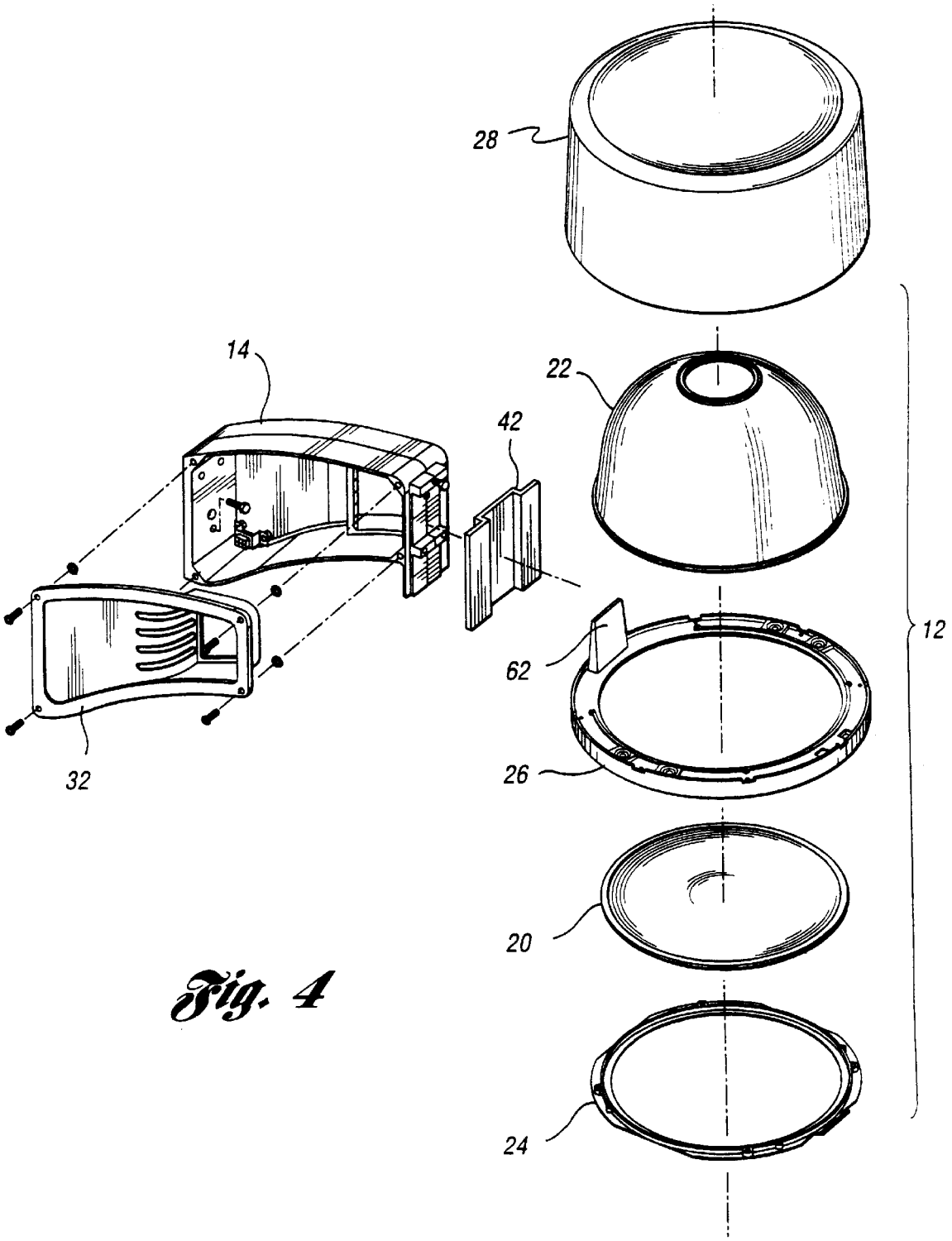
FIG. 4 is a graphic assembly illustration of the first embodiment of the outdoor luminaire assembly of the present invention.
Figure 5:
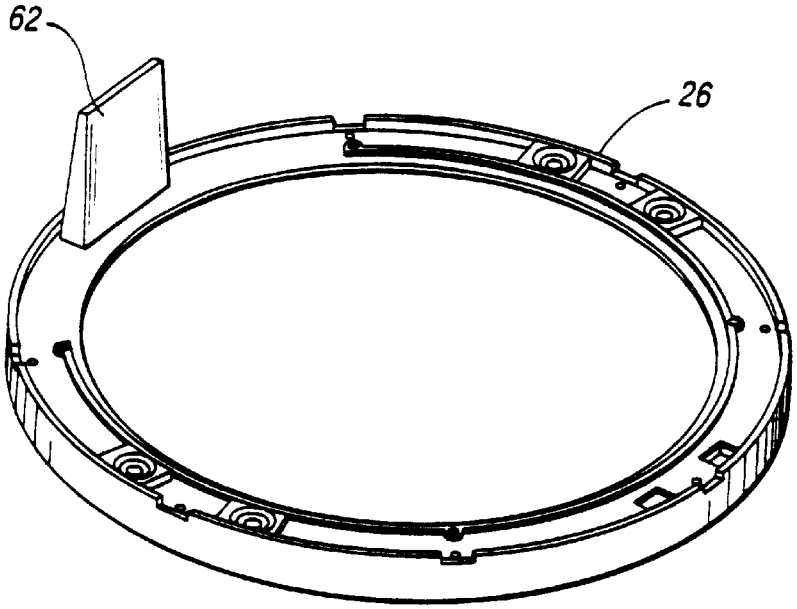
FIG. 5 is the platform bracket in accordance with embodiments of the present invention.
Figure 7:
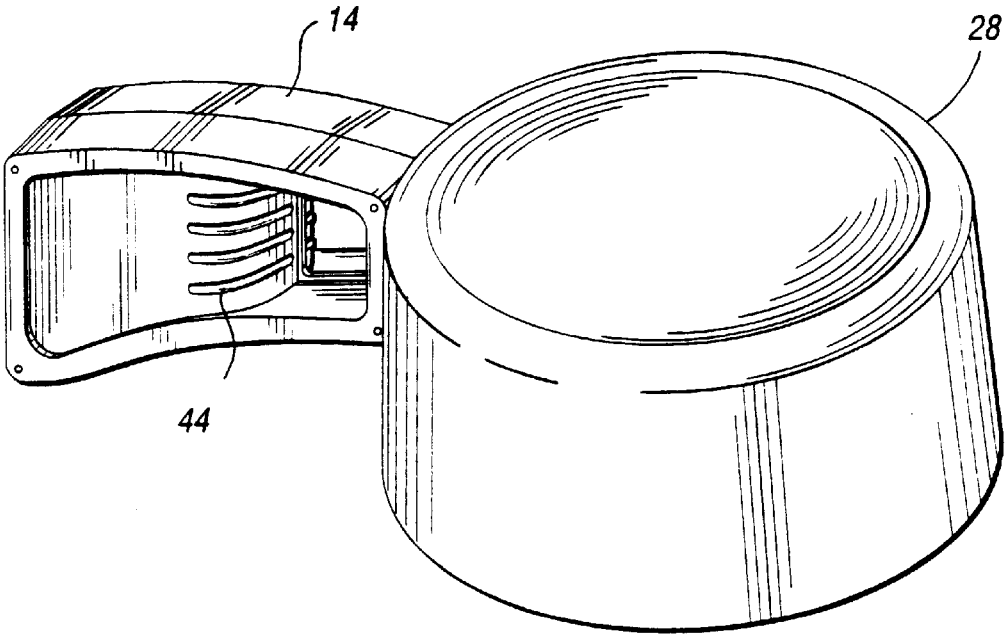
FIG. 7 is a perspective view of the first embodiment of the outdoor luminaire assembly of the present invention as shown in FIGS. 1 and 2, including one of the differently shaped cover members.
Figure 8:
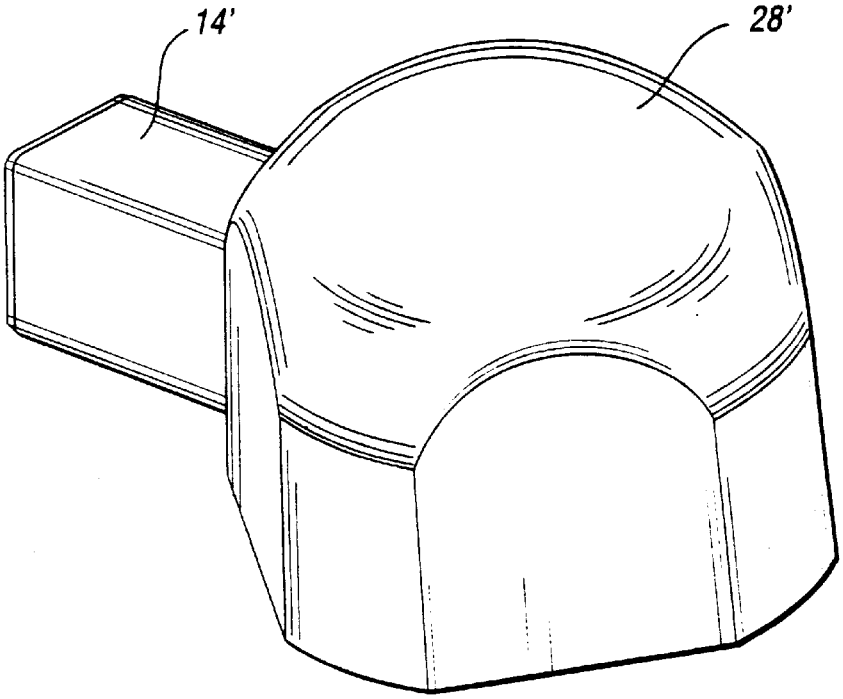
FIG. 8 is a perspective view of the second embodiment of the outdoor luminaire assembly of the present invention as shown in FIG. 3, including a second one of the differently shaped cover members.

As shown in FIGS. 4 and 7, the cover member 28 is placed over the optical assembly 12 which is adapted to receive cover member 28. The cover member 28 is preferably attached to the platform 26 of the optical assembly 12 by screws. It should be recognized, however, that the cover member 28 of the present invention may be affixed to the optical assembly 12 directly, or to the platform 26 of the optical assembly 12, by any suitable fastening means. The platform 26 is shown in more detail in FIG. 5, and is preferably formed of an aluminum alloy with a paint finish.

Although the cover member described above serves to shelter the optical assembly 12 from its surroundings and places it in environmental isolation, the cover member is not required to contribute significantly to the structural integrity of the overall assembly 10. While the cover member may be made of any material, it is preferably formed of vacuum formed plastic or composite material which is able to withstand the varied weather conditions to which it will constantly be exposed.

Figure 2:
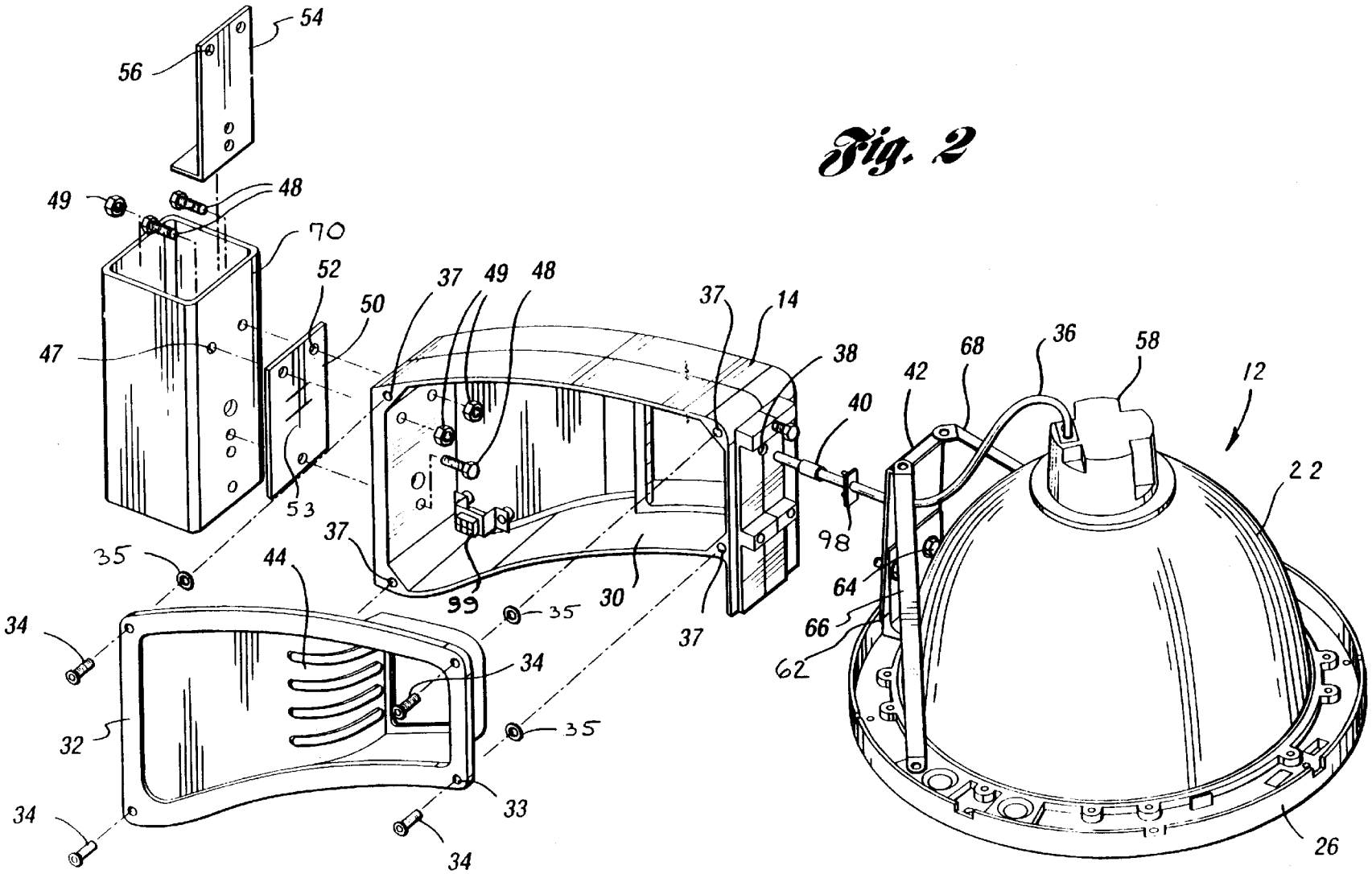
FIG. 2 is a perspective assembly diagram of the first embodiment of the outdoor luminaire assembly of the present invention.
Figure 3:
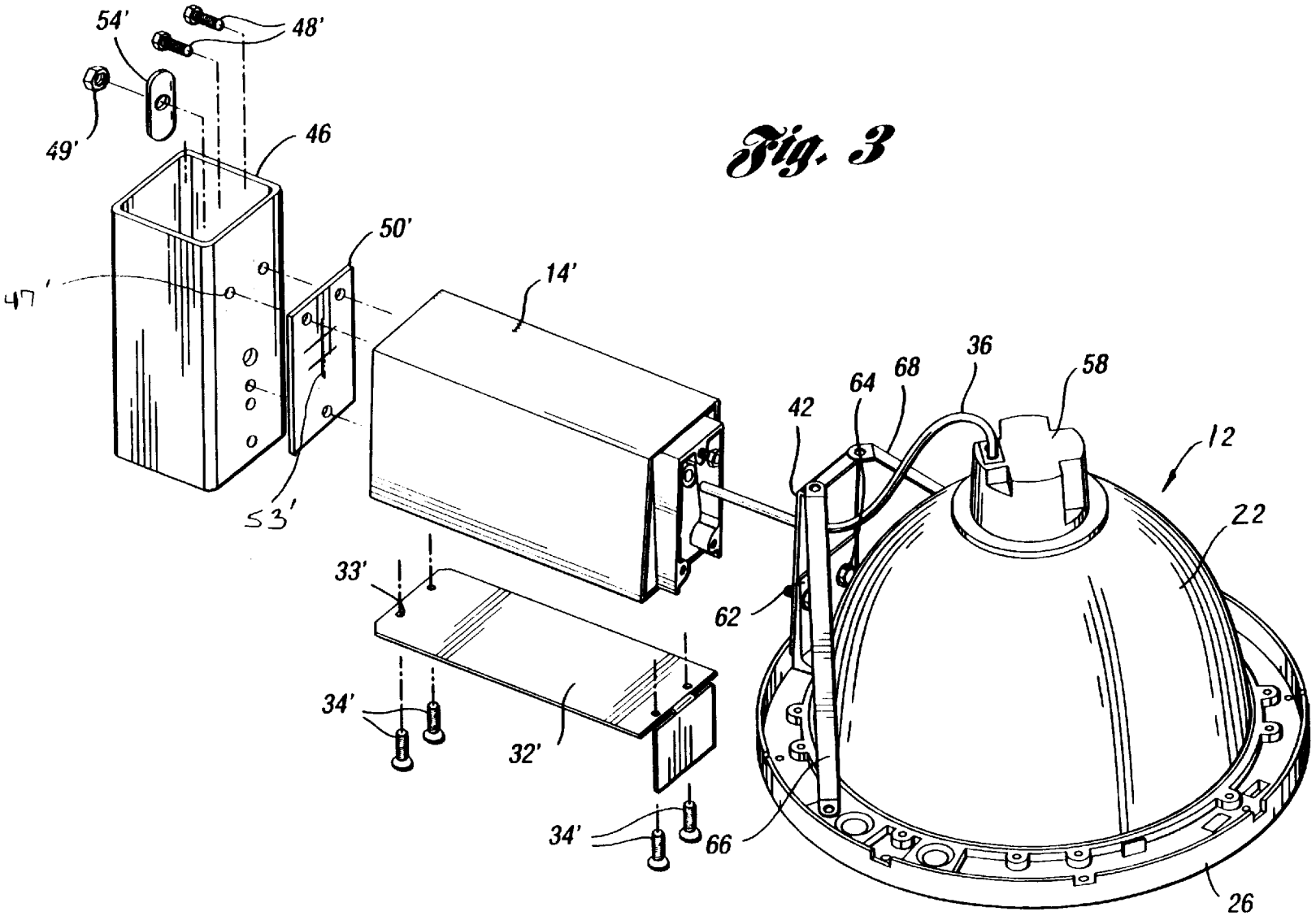
FIG. 3 is a perspective assembly diagram of a second embodiment of the outdoor luminaire assembly of the present invention.

The arm is represented as one style arm in FIGS. 1, 2, 4 and 7 as arm 14 and as another style arm shown in FIGS. 3 and 8 as arm 14'. Generally, the arm of the outdoor luminaire assembly 10 serves to support the optical assembly 12 from any surface to which the arm may be mounted. The arm also serves as the electrical assembly. As shown in FIGS. 2 and 7, the arm 14 holds the ballast 16 in a position remote from the optical assembly 12. In the preferred embodiment shown in FIG. 2, the arm 14 includes an internal chamber 30 wherein the ballast 16 is located, in addition to any other componentry, electrical or otherwise, which may be convenient to locate within internal chamber 30. The arm is preferably made of a painted cast aluminum. However, any material may be utilized which functions to withstand the high temperatures radiated by the ballast 16, such as a plastic or composite material.

The arm may have one of a plurality of different shapes. For example, one such shape is the arcuate arm 14 embodiment shown in FIGS. 1, 2, 4 and 7. A design of such shape traditionally adds strength to a component. Another example is the linear rectangular arm 14' embodiment as shown in FIGS. 3 and 8. While the shape of the arm may vary with imagination, it must be able to support the weight of the ballast 16 and other desired components located within, as well as the weight of the optical assembly 12 attached thereto.

In the preferred embodiments, the arm 14 further includes a removable panel shown as removable panel 32 in FIG. 2 and removable panel 32' in FIG. 3, which allows for easy access to the internal chamber 30 and to the ballast 16 contained therein or mounted thereto, during on-site maintenance. As shown typically in FIG. 2, the removable panel 32 has a plurality of holes 33 whereby a corresponding number of fasteners, such as screw 34 and washer 35, are used to attach the panel 32 to corresponding holes 37 in the arm 14. By removing the removable panel 32, the ballast 16 may be quickly and easily repaired or replaced without having to disable the assembly 10, and take the entire assembly down and off-site for repair. Further, the ballast 16 and other electrical componentry is detachable from the wiring 36 by way of a quick-disconnect 99 thereby allowing for ease of connection and disconnection of the ballast and related electrical componentry from the wiring 36. The ballast 16 and other electrical componentry may be disposed on removable panel 32 forming a subassembly which serves as an interchangeable module. Thus, the subassembly can be replaced in full by a replacement subassembly which is installed in its place.

In the embodiment shown in FIG. 2, the removable panel 32 is attached at the side of the arcuate-shaped arm 14. In the embodiment illustrated in FIG. 3, the removable panel 32' is attached at the bottom side of the rectangular-shaped arm 14' embodiment with screws 34'. However, it should be recognized that the removable panel could be at any location on the arm that would provide access to the ballast 16 and/or the internal chamber 30 of the arm. As shown in FIGS. 1, 2, 4 and 7, the arm 14 or the removable panel 32 may also have a plurality of ribs 44 molded into it, as shown molded into the removable panel 32 of the arcuate design for the arm 14. These ribs 44 may be for design purposes.

As further shown in FIG. 2, the arm 14 further includes at least one opening 38 for receiving the wiring 36 from the lamp 18 by way of the socket housing 58 for connection to ballast 16, the socket housing 58 being in electrical communication with the lamp 18 of the optical assembly 12. The wiring 36 typically is connected to a plug-type quick-disconnect end 99 which makes it capable of readily connecting to and disconnecting from ballast 16. Therefore no hard wiring or splicing is necessary during maintenance. Also preferably included at the same end is a grommet 40 and strap 98 in order to plug opening 38. This opening 38, shown as a hole in FIG. 2, is positioned where the arm 14 mates to the junction bracket 42 of the optical assembly 12. The cover member 28 has a cut-out (not shown) at the location where the junction bracket 42 and arm 14 are mated so that the cover member 28 may fit over the assembly.

The junction bracket 42 is preferably attached to the upstanding tab 62 of platform 26 by a plurality of fasteners 64 such as the screws shown in FIG. 2. In the preferred embodiment, there are two support brackets 66 and 68 securely fastened at one end to the platform 26 and at the other end to junction bracket 42 in order to support and give stability to the junction bracket 42.

The luminaire assembly 10 may be positioned for use anywhere such as directly to a building. However, it is preferably attached to a stanchion or pole at a distance far above the ground, either directly as shown in FIG. 2 attached to a square pole 70, or by way of a fitter 46 as shown in FIG. 3. The pole however may be of any configuration or cross-section capable of supporting the assembly 10.

The fitter 46 is typically used when the assembly is to be mounted to a round pole, not shown in FIG. 3, whereby the fitter 46 slides over the stanchion or pole. Regardless of whether the assembly 10 is attached to the pole 70 or to the fitter 46, each is attached to the arm 14 by way of fasteners, such as the couplings of screws 48 and nuts 49, as representatively shown in FIG. 2. As a result, and for purposes of this discussion, the attachment will be discussed in terms of FIG. 2 which utilizes pole 70. However, the discussion is equally applicable to the use of the fitter 46 as shown in FIG. 3. Like components of FIG. 3 are designated with prime (') designations.

Between the arm 14 and the pole 70 is a pole gasket 50 having holes 52, which correspond to holes 47, and through which the screws 48 which attach the arm 14 to pole 70 are inserted. The pole gasket also contains a slit 53 which corresponds to wireway openings in pole 70, arm 14 and strain relief bracket 54. The pole gasket 50 forms a seal from the outdoor elements between pole 70 and arm 14. A strain relief bracket 54 is also preferably positioned within the pole 70 as shown in FIG. 2, the strain relief bracket 54 having one or a plurality of holes 56 respectively aligned with those holes 52 of the pole gasket 50 as well as the holes 47.

The strain relief bracket 54 provides additional support and strain relief for the electrical power source wiring group (not shown) which extends the length of the pole or stanchion. A power source (not shown) in cooperation with the power source wiring group, provides energization means for powering the electrical assembly. Electrical energy is thus transferred from the electrical power source wiring group to the lamp 18 via the electrical assembly of the arm which contains the ballast and other electrical componentry, and the wiring 16.

Whether the attachment is to the pole or the fitter, a cap (not shown) may be installed on top of the pole. When the fitter 46 is utilized as illustrated in FIG. 3, set screws (not shown) may also be employed to secure fitter 46 to its pole.

Figure 6:
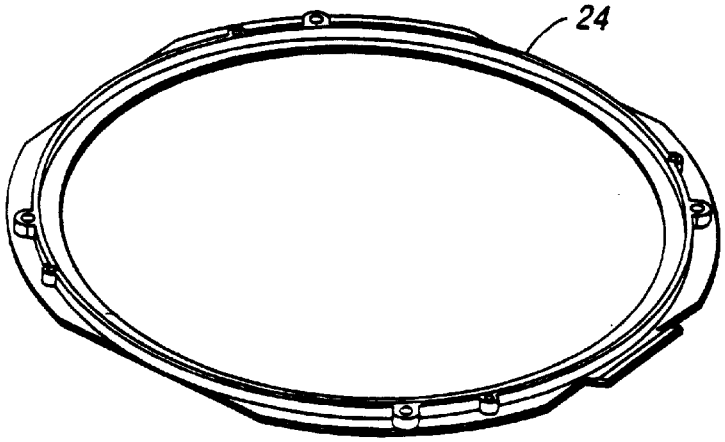
FIG. 6 is the glass door in accordance with embodiments of the present invention.

As shown in FIG. 4, the glass roundel 20, which can be of the planar or sagged variety, is supported in the optical assembly 12 and sandwiched between the platform 26 and the glass door 24. The platform 26 and glass door 24 are removably attached to each other for retaining the glass roundel 20. It is through the glass door 24 that the lamp 18 is accessed for relamping purposes. The glass door 24 is shown in more detail in FIG. 6.

By locating the ballast 16 remotely from the optical assembly 12 by using wiring 36 or a wire harness to carry power from the ballast 16 and other electrical componentry to the lamp, embodiments of the present invention are advantageous in making the ballast 16 and other components readily serviceable. A remotely located ballast further allows the ballast to run considerably cooler, thereby extending its life.

By providing a cover member 28 to the assembly, aesthetic goals are achieved as well as ease of interchangeability and repair in the event that a cover member requires maintenance or repair. For example, removal or replacement of the cover member may be necessary if the surface of a cover member is penetrated by a foreign substance, or if a cover member is fractured as a result of weather conditions or tampering. These again are time-consuming and labor intensive maintenance procedures that must be performed on-site. A maintenance-friendly interchangeable cover would resolve any such dilemma.

While the invention has been particularly shown and described in reference to the preferred embodiment thereof, it will be understood by those skilled in the art that various changes in form and details may be made therein without departing from the spirit and scope of the invention.

What is claimed is:

1. An outdoor luminaire assembly attachable to a mounting stanchion, comprising:

a sealable optical assembly including a base plate having an upper mounting surface and a lower mounting surface, a decorative cover member selected from a group of corresponding cover members and affixable to the base plate upper mounting surface, and a glass door affixable to the base plate lower mounting surface;

an arm for supporting the optical assembly from the mounting stanchion; and a ballast enclosed within the arm for energizing a lamp.

2. The outdoor luminaire assembly of claim 1 wherein the arm is comprised of an aluminum material.

3. The outdoor luminaire assembly of claim 1 wherein the arm has a removable panel to allow access to the ballast.

4. The outdoor luminaire assembly of claim 1 wherein the arm receives wiring from the lamp, the wiring for connection to the ballast.

* * * * *